US009931841B2

(12) United States Patent
Kubota et al.

(10) Patent No.: US 9,931,841 B2
(45) Date of Patent: Apr. 3, 2018

(54) MANUFACTURING METHOD OF LIQUID JET HEAD, LIQUID JET HEAD, AND LIQUID JET APPARATUS

(71) Applicant: SII Printek Inc., Chiba-shi, Chiba (JP)

(72) Inventors: Yuzuru Kubota, Chiba (JP); Taihei Yamaguchi, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 15/337,658

(22) Filed: Oct. 28, 2016

(65) Prior Publication Data

US 2017/0129239 A1 May 11, 2017

(30) Foreign Application Priority Data

Nov. 9, 2015 (JP) ..... 2015-219611

(51) Int. Cl.
*B41J 2/14* (2006.01)
*B41J 2/16* (2006.01)

(52) U.S. Cl.
CPC ..... *B41J 2/14209* (2013.01); *B41J 2/1433* (2013.01); *B41J 2/162* (2013.01); *B41J 2/1609* (2013.01); *B41J 2/1642* (2013.01); *B41J 2/1643* (2013.01); *B41J 2002/14411* (2013.01); *B41J 2002/14491* (2013.01)

(58) Field of Classification Search
CPC .... B41J 2/14209; B41J 2/1433; B41J 2/1609; B41J 2/162
See application file for complete search history.

(56) References Cited

U.S. PATENT DOCUMENTS 8,128,207 B2 * 3/2012 Koseki ..... B41J 2/14209 347/68
2015/0266294 A1 * 9/2015 Horiguchi ..... B41J 2/14201 347/68

FOREIGN PATENT DOCUMENTS

JP 2002210955 7/2002

* cited by examiner

*Primary Examiner* — Kristal Feggins
*Assistant Examiner* — Kendrick Liu
(74) *Attorney, Agent, or Firm* — Bruce L. Adams; Klintworth & Rozenblat IP LLP

(57) ABSTRACT

A manufacturing method of a liquid jet head includes: a groove formation step of forming ejection grooves and non-ejection grooves alternately in the upper surface of an actuator substrate; a cover plate processing step of forming a recessed portion in the upper surface of a cover plate and slits penetrating from the bottom surface of the recessed portion to the lower surface opposite to the upper surface; an electrode formation step of forming conductive films on the both side surfaces and front surface of the ejection grooves, the both side surfaces of the non-ejection grooves, the inner surfaces of the slits and the recessed portion, and the lower surface of the cover plate; and a substrate joining step of joining the lower surface of the cover plate to the upper surface of the actuator substrate so as to communicate the slits with the ejection grooves.

7 Claims, 8 Drawing Sheets

MANUFACTURING METHOD OF LIQUID JET HEAD, LIQUID JET HEAD, AND LIQUID JET APPARATUS

BACKGROUND

Technical Field

The present invention relates to a manufacturing method of a liquid jet head that jets liquid droplets onto a recording medium for recording, a liquid jet head, and a liquid jet apparatus.

Related Art

In recent years, ink jet-type liquid jet heads have been used to eject ink droplets onto recording paper or the like to record texts and graphics or to eject a liquid material onto the surface of an element substrate to form a functional thin film. According to this system, a liquid such as an ink or a liquid material is guided from a liquid tank to a channel (ejection grooves) via a supply tube, and a pressure is applied to the liquid charged in the channel to eject the liquid from a nozzle communicating with the channel. Then, at the time of ejecting the liquid, texts and graphics are recorded or a functional thin film or a three-dimensional structure of a determined shape is formed while the liquid jet head or the recording medium is moved.

JP 2002-210955 A describes this kind of liquid jet head. FIG. 11 is a schematic cross-sectional view of a liquid jet head (FIG. 2 of JP 2002-210955 A). The liquid jet head includes a head chip 110 that ejects ink droplets and an ink manifold member 120 that supplies an ink to the head chip 110. The head chip 110 includes a channel portion 115. The channel portion 115 is surrounded by two drive walls not illustrated and are made of piezoelectric bodies, lower and upper substrates 111 and 113, a back plate 119, and a nozzle plate 118. The ink manifold member 120 includes an ink flow path 121 and an upper wrapping portion 122*a*. The upper wrapping portion 122*a* covers the upper substrate 113 of the head chip 110 and is joined to the back plate 119 of the head chip 110. The ink flowing into the ink flow path 121 is supplied to the channel portion 115 via an ink introduction opening 119*a* of the back plate 119. When the drive walls of the channel portion 115 are driven, the ink droplets are ejected from a nozzle hole 118*a*.

A conductive member 117*b* penetrates to the upper substrate 113 in the thickness direction. The conductive member 117*b* is electrically connected to drive electrodes that are installed on the drive walls driving the channel portion 115. The upper wrapping portion 122*a* includes an electrode 123 penetrating in the thickness direction.

The electrode 123 is installed in a position corresponding to the conductive member 117*b*. The electrode 123 is electrically connected to the conductive member 117*b* via an electrode 117*c* formed on the upper surface of the upper substrate 113. The electrode 123 is further electrically connected to an electrode 124 formed on an upper surface 120*a* and is drawn out to a back surface 120*b*. Therefore, a drive waveform for driving the drive walls is input to the electrode 124 on the back surface 120*b* and is supplied to the drive electrodes on the drive walls through the electrode 123 installed on the upper wrapping portion 122*a* and the conductive member 117*b* installed on the upper substrate 113.

In the liquid jet head described in JP 2002-210955 A, the drive electrodes are formed inside the channel portion 115 by electroless plating method, a through-hole is opened in the upper substrate 113, silver paste or the like is charged into the hole to form the conductive member 117*b*, and the electrode 117*c* is formed on the upper surface of the upper substrate 113. In addition, a through-hole is also opened in the upper wrapping portion 122*a* and the electrode 123 is charged into the hole, and the pattern of the electrode 124 is formed on the ink manifold member 120 from the upper surface 120*a* to the back surface 120*b*. Accordingly, the electrode formation is extremely complicated.

SUMMARY

A manufacturing method of a liquid jet head according to the present invention includes: a groove formation step of forming ejection grooves and non-ejection grooves alternately in a reference direction in an upper surface of an actuator substrate; a cover plate processing step of forming a recessed portion in the upper surface of a cover plate and slits penetrating from a bottom surface of the recessed portion to a lower surface of the cover plate; an electrode formation step of forming conductive films inside the recessed portion, inside the slits, on the lower surface of a cover plate in the vicinities of the slits, and on the upper surface of the actuator substrate in the vicinities of end portions of the ejection grooves; and a substrate joining step of joining the lower surface of the cover plate to the upper surface of the actuator substrate so as to communicate the slits with the ejection grooves as well as of connecting electrically the conductive films formed in the vicinities of the slits to the conductive films in the vicinities of the end portions of the ejection grooves.

Further, in the manufacturing method of a liquid jet head according to the present invention, the substrate joining step is a step of joining the cover plate to the actuator substrate while the upper surface of the actuator substrate and the non-ejection grooves are partly exposed to the outside.

Further, in the manufacturing method of a liquid jet head according to the present invention, the electrode formation step is a step of forming the conductive films by plating or vapor deposition.

Further, in the manufacturing method of a liquid jet head according to the present invention, the groove formation step is a step of forming a wiring groove in parallel to the non-ejection grooves, the cover plate processing step is a step of further forming, in an upper surface of the cover plate, an additional recessed portion communicating with the recessed portion and an additional slit penetrating from a bottom surface of the additional recessed portion to a lower surface of the cover plate opposite to the upper surface, the electrode formation step is a step of forming the conductive films on an inner surface of the wiring groove, in the vicinity of the end portion of the wiring groove in the upper surface of the actuator substrate, on an inner surface of the additional recessed portion, inner side surfaces of the additional slit, and in the vicinity of the additional slit in the lower surface of the cover plate, and the substrate joining step is a step of communicating the additional slit with the wiring groove as well as of connecting electrically the conductive film formed in the vicinity of the end portion of the wiring groove to the conductive film formed in the vicinity of the additional slit.

A liquid jet head according to the present invention includes: an actuator substrate in which ejection grooves and non-ejection grooves are arranged alternately in a reference direction; and a cover plate that is joined to the actuator substrate and includes a recessed portion in an upper surface and slits penetrating from a bottom surface of the recessed portion to a lower surface of the cover plate and communicating with the ejection grooves, and common drive electrodes are formed on side surfaces of the ejection grooves, actuator-side connection terminals continued to the common drive electrodes are formed on an upper surface of the actuator substrate in the vicinity of longitudinal end portions of the ejection grooves, and individual drive electrodes are formed on side surfaces of the non-ejection grooves, and common wiring is formed on inner side surfaces of the slits and an inner surface of the recessed portion, cover plate-side connection terminals continued to the common wiring are formed on a lower surface of the cover plate at positions corresponding to the actuator-side connection terminals, and the common drive electrodes formed in a plurality of the ejection grooves are electrically connected together via the actuator-side connection terminals, the cover plate-side connection terminals, and the common wiring.

Further, in the liquid jet head according to the present invention, the non-ejection grooves are formed from one end portion to the other end portion of the actuator substrate, the ejection grooves are formed from the one end portion to a position immediately before the other end portion of the actuator substrate, the cover plate is joined to the upper surface of the actuator substrate such that the slits and the ejection grooves communicate with each other, individual terminals are formed on the upper surface of the actuator substrate in the vicinity of the other end portion, and the individual terminals electrically connect two of the individual drive electrodes formed in adjacent two of the non-ejection grooves sandwiching the ejection groove therebetween.

Further, in the liquid jet head according to the present invention, the actuator substrate includes a wiring groove formed in the vicinity of the end portion in the reference direction, a wiring electrode formed on the inner surface of the wiring groove, and a common terminal formed on an upper surface where the wiring groove is opened, the cover plate includes an additional recessed portion that communicates with the recessed portion, an additional slit that penetrates from a bottom surface of the additional recessed portion to a lower surface of the cover plate, additional wiring that is formed on an inner surface of the additional recessed portion and inner side surfaces of the additional slit, and cover plate-side connection terminals that are continued to the additional wiring and formed on the lower surface of the cover plate at positions corresponding to the common terminal, and the common terminal is electrically connected to the common wiring via the cover plate-side connection terminals, the wiring electrode, and the additional wiring.

Further, in the liquid jet head according to the present invention, the actuator substrate includes individual terminals electrically connected to the individual drive electrodes, the common terminal is electrically connected to the common wiring and is formed on the upper surface of the actuator substrate at the end portion side in the reference direction, and the individual terminals are formed on the upper surface of the actuator substrate more inside than the common terminal in the reference direction.

Further, a liquid jet apparatus according to the present invention includes: the liquid jet head according to the present invention; a movement mechanism configured to move relatively the liquid jet head and a recording medium; a liquid supply tube configured to supply a liquid to the liquid jet head; and a liquid tank configured to supply the liquid to the liquid supply tube.

A manufacturing method of a liquid jet head according to the present invention includes: a groove formation step of forming ejection grooves and non-ejection grooves alternately in a reference direction in an actuator substrate (upper surface); a cover plate processing step of forming a recessed portion to be a common ink chamber in the upper surface of a cover plate and slits penetrating from the bottom surface of the recessed portion to the lower surface of the cover plate; an electrode formation step of forming electrodes in the common ink chamber of the cover plate, in the slits, in cover plate-side connection terminals connected to the slits, and in actuator-side connection terminals connected to the ejection grooves of the actuator substrate; and a substrate joining step of joining the lower surface of the cover plate to the upper surface of the actuator substrate to communicate the slits with the ejection grooves. As a result, a liquid jet head can be manufactured without using a chevron wafer for the actuator substrate. In addition, the electronic pattern can be created in the laminated surface without increasing significantly man-hours and facility investments, and common wiring can be easily extracted from the chip end surface separately from individual wiring to decrease the number of electrodes retrieved.

DETAILED DESCRIPTION

First Embodiment

Figure 1:
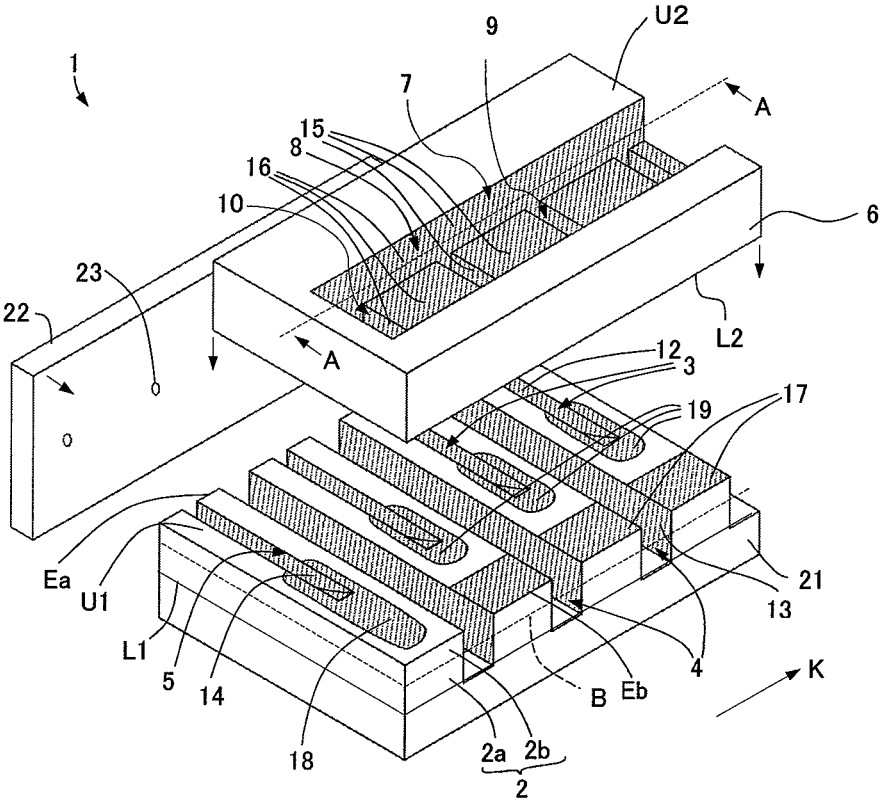
FIG. 1 is an explanatory diagram of a liquid jet head according to a first embodiment of the present invention.
Figure 2:
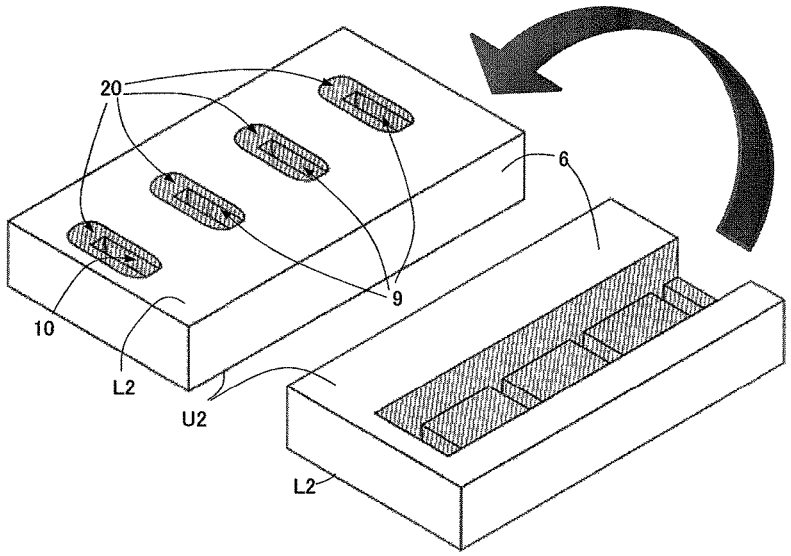
FIG. 2 is an explanatory diagram of a cover plate according to the first embodiment of the present invention.
Figure 3:
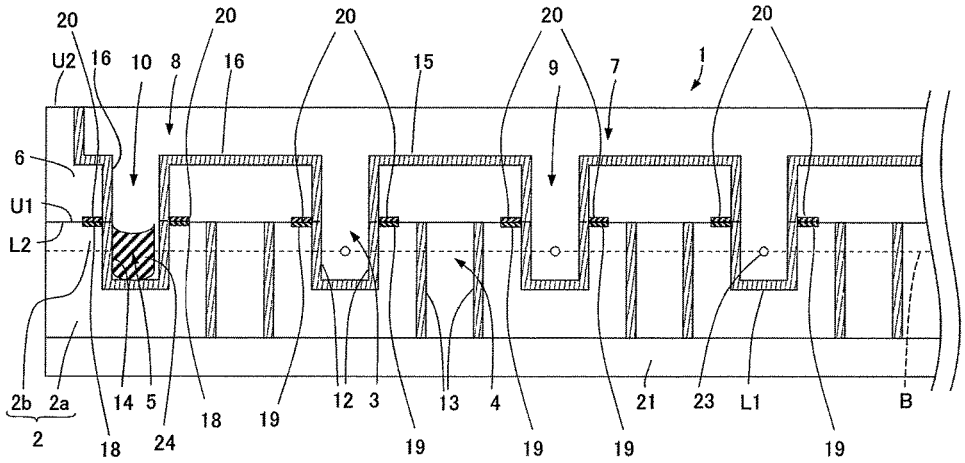
FIG. 3 is an explanatory diagram of the liquid jet head according to the first embodiment of the present invention.

FIGS. 1 and 2 are explanatory diagrams of a liquid jet head 1 according to a first embodiment of the present invention. FIG. 1 is a schematic exploded partial perspective view of the liquid jet head 1. The shaded sections in FIG. 1 show the sections on which electrodes are to be formed (the same applies to the subsequent drawings). FIG. 2 represents a cover plate 6 illustrated in FIG. 1 with the back surface on the upper left side and the front surface on the lower right side. FIG. 3 is a schematic vertical cross-sectional view of the liquid jet head 1 illustrated in FIG. 1 taken along line AA.

The liquid jet head 1 includes an actuator substrate 2, the cover plate 6 joined to the actuator substrate 2, and a nozzle plate 22 installed on the end surface of the actuator substrate 2. In this embodiment, the actuator substrate has a reinforcing plate 21 on the side opposite to the cover plate. Alternatively, without installing the reinforcing plate 21, the lower parts of ejection grooves 3 and non-ejection grooves 4 may be formed by a piezoelectric substrate 2*a* described later.

The actuator substrate 2 has the ejection grooves 3 and the non-ejection grooves 4 alternately arranged in a reference direction K. The cover plate 6 includes a recessed portion 7 in an upper surface U2, and slits 9 that penetrate from the bottom surface of the recessed portion 7 to a lower surface L2 opposite to the upper surface U2 and that communicate with the ejection grooves 3. Common drive electrodes 12 are formed on both side surfaces of the ejection grooves 3, individual drive electrodes 13 are formed on both side surfaces of the non-ejection grooves 4, and common wiring 15 is formed on the inner side surfaces of the slits 9 and the inner surface of the recessed portion 7. In addition, the common drive electrodes 12 formed in a plurality of the ejection grooves 3 are electrically connected via the common wiring 15.

Specifically describing, the actuator substrate 2 is a chevron-type substrate in which a piezoelectric substrate 2*a* polarized in the normal direction of the substrate surface and a piezoelectric substrate 2*b* polarized in the direction opposite to the piezoelectric substrate 2*a* are laminated. A boundary B between the piezoelectric substrate 2*a* and the piezoelectric substrate 2*b* is positioned at an approximately half the depth of the ejection grooves 3 or the non-ejection grooves 4. The non-ejection grooves 4 are formed from one end portion Ea to the other end portion Eb of the actuator substrate 2. The ejection grooves 3 are formed from the one end portion Ea to a position immediately before the other end portion Eb of the actuator substrate 2. The cover plate 6 is joined to the upper surface U1 of the actuator substrate 2 such that the slits 9 and the ejection grooves 3 communicate with each other. That is, the cover plate 6 is joined to the actuator substrate 2 to cover the ejection grooves 3 except for the slits 9 and expose the upper surface U1 in the vicinity of the other end portion Eb. Individual terminals 17 are formed on the upper surface U1 of the actuator substrate 2 in the vicinity of the other end portion Eb. The individual terminals 17 electrically connect two of the individual drive electrodes 13 formed, on the side of the ejection groove 3, on the surfaces of the two adjacent non-ejection grooves 4 with the ejection groove 3 therebetween.

The actuator substrate 2 further includes a wiring groove 5 that is formed in parallel to the non-ejection grooves 4 in the vicinity of the end portion in the reference direction K, a wiring electrode 14 that is formed on the inner surface of the wiring groove 5, and a common terminal 18 that is formed on the upper surface U1 where the wiring groove 5 is opened. The cover plate 6 includes an additional recessed portion 8 that communicates with the recessed portion 7, an additional slit 10 that penetrates from the bottom surface of the additional recessed portion 8 to the lower surface L2 and communicates with the additional recessed portion 8, and additional wiring 16 that is formed on the inner surface of the additional recessed portion 8 and the inner side surfaces of the additional slit 10. The common terminal 18 connects electrically to the common wiring 15 via the wiring electrode 14 and the additional wiring 16. The wiring groove 5 may be formed only in the vicinity of one end of the actuator substrate 2 in the reference direction K.

Therefore, the common terminal 18 connects electrically to the common drive electrodes 12 and is formed on both end sides of the upper surface U1 of the actuator substrate 2 in the reference direction K. In addition, the individual terminals 17 connect electrically to the individual drive electrodes 13 and are formed on the upper surface U1 of the actuator substrate 2 more inside than the common terminal 18 in the reference direction K. The common terminal 18 may be formed only on the one end side of the actuator substrate 2 in the reference direction K. As described above, by forming the common terminal 18 on the end sides of the actuator substrate 2, the electrode width of the common terminal 18 can be made large without restrictions by the pitches of the ejection grooves 3 and the non-ejection grooves 4.

The nozzle plate 22 includes nozzles 23 communicating with the ejection grooves 3 and is connected to the end surface of the one end portion Ea of the actuator substrate 2. The additional recessed portion 8, the additional slit 10, or the wiring groove 5 is desirably sealed by an adhesive 24 or the like as illustrated in FIG. 3 after the formation of the additional wiring 16 and the wiring electrode 14 to prevent a liquid charged in the recessed portion 7 from leaking to the outside. In addition, the individual terminals 17 and the common terminal 18 are electrically connected to the drive circuit via wiring in a flexible circuit board not illustrated.

In this example, the actuator substrate 2 can be made of a piezoelectric material such as PZT ceramic. The cover plate 6 can be made of a PZT ceramic material, another insulating material, a plastic material, or a light-pervious substrate, for example, a glass material. The nozzle plate 22 can be made of a plastic material such as a polyimide film or a metallic material such as SUS. The reinforcing plate 21 is installed as necessary. For example, alternatively, the piezoelectric substrate 2*a* may be made thick and the ejection grooves 3 and the non-ejection grooves 4 may be formed with a depth necessary for the piezoelectric substrate 2*a*.

In the cover plate 6, conductive films are formed, by electroless plating method or evaporation, on the inner surfaces of the recessed portion 7, the inner side surfaces of the slits 9, the additional slit 10 penetrating from the bottom surface of the additional recessed portion 8 to the lower surface L2, the common wiring 15, and cover plate-side connection terminals 20. Similarly, conductive films can be formed on the common drive electrodes 12, the common terminal 18, the individual drive electrodes 13, the individual terminals 17, and actuator-side connection terminals 19 of the actuator substrate.

The common wiring 15, the common drive electrodes 12, and the individual drive electrodes 13 can be formed simultaneously by roughening the inner surface of the recessed portion 7 and the inner side surfaces of the slits 9 and then forming conductive films on the surfaces by electroless plating method. In addition, the common wiring 15, the common drive electrodes 12, the individual drive electrodes 13, and the individual terminals 17 can be formed simultaneously by roughening the inner surface of the recessed portion 7 and the inner side surfaces of the slits 9 and further roughening the upper surface U1 of the actuator substrate 2 in the vicinity of the other end portion Eb by sandblasting or the like, and then forming the conductive films by electroless plating method. Moreover, the common terminal 18 electrically connecting to the common wiring 15 can be formed simultaneously with the other electrodes by forming, in the cover plate 6, the additional recessed portion 8 communicating with the recessed portion 7 and the additional slit 10 penetrating from the bottom surface of the additional recessed portion 8 to the lower surface L2 and then forming the conductive films by electroless plating method. The upper surface U2 and the end surface of the end portion Eb of the cover plate 6 are mirror-finished. Accordingly, at the time of formation of the conductive films by electroless plating method, no conductive film is formed on the upper surface U2 and the end surface of the end portion Eb of the cover plate 6.

The liquid jet head 1 operates as described below. A liquid reservoir unit not illustrated supplies a liquid to the recessed portion 7 via a flow path member not illustrated. The liquid is charged into the ejection grooves 3 via the slits 9. Next, the GND potential is given to the common terminal 18 and the drive waveform is given to the individual terminals 17. The common drive electrodes 12 in the ejection grooves 3 are at the GND potential, and the drive waveform is transferred to the two individual drive electrodes 13, at the side of the ejection groove 3, in the two non-ejection grooves 4 sandwiching the ejection groove 3 therebetween to deform the both side walls of the ejection groove 3 by thickness shear. For example, the both side walls of the ejection grooves 3 are deformed such that the capacity of the ejection grooves 3 increases to draw the liquid from the recessed portion 7. Then, the both side walls of the ejection grooves 3 are deformed to the original position before the deformation or such that the capacity of the ejection grooves 3 decreases to eject liquid droplets from the nozzles 23.

The liquid jet head 1 of the embodiment is an edge-chute type in which the nozzle plate 22 is installed at the one end portion Ea of the actuator substrate 2. Alternatively, the liquid jet head 1 may be a side-chute type in which the nozzle plate 22 is installed on the lower surface L1 of the actuator substrate 2. In this case, the ejection grooves 3 are formed from a position immediately before the one end portion Ea to a position immediately before the other end portion Eb of the actuator substrate 2. In addition, a recessed portion and slits penetrating from the bottom surface of the recessed portion to the lower surface L2 are newly formed in the upper surface U2 of the cover plate 6 in the vicinity of the one end portion, and the slits are communicated with the one end portions of the ejection grooves 3. Common electrode similar to the common wiring 15 may be formed on the inner surface of the recessed portion and the inner side surfaces of the slits. In addition, instead of the reinforcing plate 21, the nozzle plate 22 is installed on the lower surface L1. In this case, by forming the nozzle plate 22 from such a material as glass, for example, the individual drive electrodes 13 opposed to each other in the single non-ejection groove 4 described above can be electrically separated.

Second Embodiment

Figure 4:
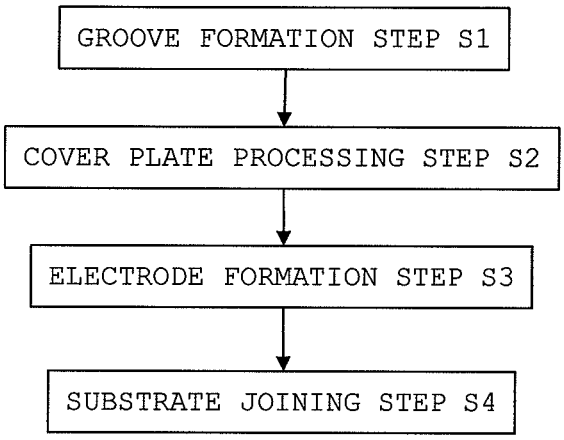
FIG. 4 is a process chart describing a manufacturing method of the liquid jet head according to a second embodiment of the present invention.

FIG. 4 is a process chart describing a manufacturing method of the liquid jet head 1 according to a second embodiment of the present invention. This embodiment represents a basic manufacturing method of the liquid jet head 1 according to the present invention. The same components or the components having the same functions are given the same reference signs.

The manufacturing method illustrated in FIG. 4 will be described with reference to FIG. 1. The manufacturing method of the liquid jet head 1 of the present invention includes a groove formation step S1 of forming the ejection grooves 3 and the non-ejection grooves 4 in the actuator substrate 2, a cover plate processing step S2 of forming the recessed portion 7 and the slits 9 in the cover plate 6, an electrode formation step S3 of forming the conductive films (correspond to the common drive electrodes 12, the individual drive electrodes 13, and the common wiring 15 in the example of FIG. 1), and a substrate joining step S4 of joining the cover plate 6 and the actuator substrate 2. At the groove formation step S1, the ejection grooves 3 and the non-ejection grooves 4 are alternately formed in the upper surface U1 of the actuator substrate 2 in the reference direction K, and the wiring groove 5 is formed at the both end positions in the reference direction K. At the cover plate processing step S2, the recessed portion 7, the additional recessed portion 8, the slits 9 penetrating from the bottom surface of the recessed portion 7 to the lower surface L2 opposite to the upper surface U2 of the cover plate 6, and the additional slit 10 penetrating from the bottom surface of the additional recessed portion 8 to the lower surface L2 opposite to the upper surface U2 of the cover plate 6 are formed in the upper surface U2 of the cover plate 6. At the substrate joining step S4, the lower surface L2 of the cover plate 6 is joined to the upper surface U1 of the actuator substrate 2 to communicate the slits 9 with the ejection grooves 3 and communicate the additional slit 10 with the wiring groove 5.

At the electrode formation step S3, conductive films 11 to be the common drive electrodes 12 and the individual drive electrodes 13 are formed on the side surfaces of the ejection grooves 3 and the side surfaces of the non-ejection grooves 4 of the actuator substrate 2, and conductive films 11 to be the individual terminals 17, the common terminal 18, and the actuator-side connection terminals 19 are formed on the upper surface U1 of the actuator substrate 2. In addition, a conductive film 11 to be the common wiring 15 is formed on the inner side surfaces of the slits 9 and the inner surface of the recessed portion 7 of the cover plate 6, a conductive film 11 to be the additional wiring 16 is formed on the inner side surfaces of the additional slit 10 and the inner surface of the additional recessed portion 8 of the cover plate 6, and conductive films 11 to be the cover plate-side connection terminals 20 are formed on the lower surface L2 of the cover plate 6.

Specifically, the actuator-side connection terminals 19 are formed on the upper surface U1 of the actuator substrate 2 in the vicinities of the end portions of the ejection grooves 3. The vicinities of the end portions refer to the peripheries of regions where the ejection grooves 3 rise toward the upper surface U1 at the other end portion Eb side. The actuator-side connection terminals 19 are continued to the common drive electrodes 12. The cover plate-side connection terminals 20 are formed on the lower surface L2 of the cover plate 6 in the vicinities of the slits 9. The vicinities refer to the peripheries of regions where the slits 9 are formed, and are positions corresponding to the actuator-side connection terminals 19 when the actuator substrate 2 and the cover plate 6 are joined together. The cover plate-side connection terminals 20 are continued to the common wiring 15.

Figure 7:
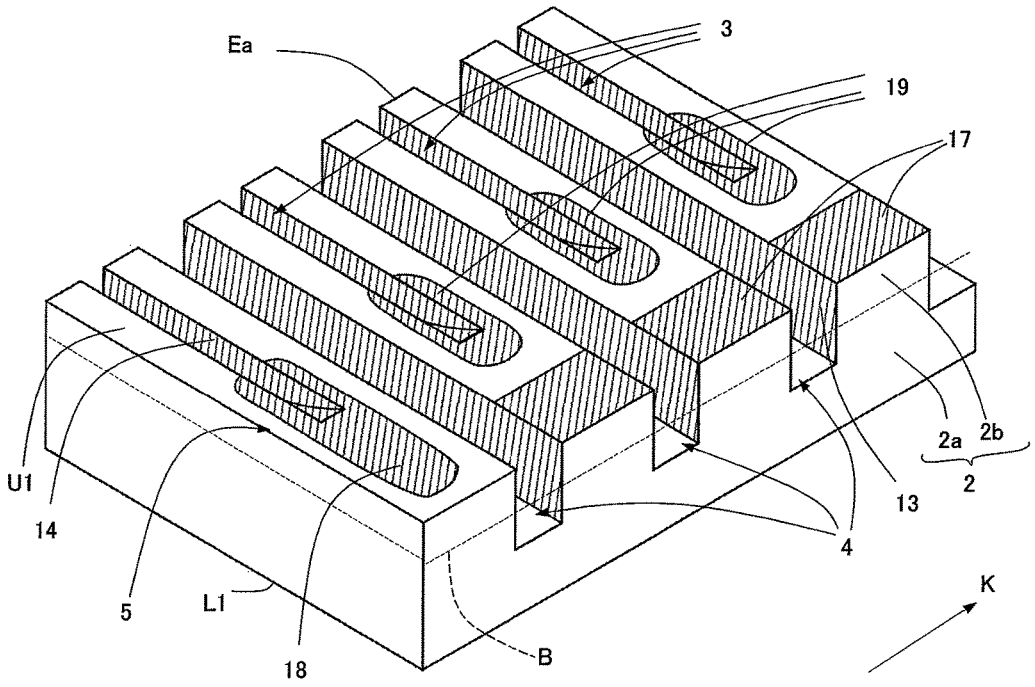
FIG. 7 is an explanatory diagram of the manufacturing method of the liquid jet head according to the third embodiment of the present invention.

In addition, the common terminal 18 is formed on the upper surface U1 of the actuator substrate 2 in the vicinity of the end portion of the wiring groove 5. The vicinity of the end portion refers to the periphery of a region where the wiring groove 5 rises toward the upper surface U1 at the other end portion Eb side. The common terminal 18 is continued to the wiring electrode 14. FIG. 7 illustrates the common terminal 18 that is further extended from the periphery of the rising portion toward the end portion Eb side. The extended portion is formed up to the position corresponding to the individual terminals 17 in the reference direction K, and can receive a drive signal by attaching a flexible substrate not illustrated.

Further, the cover plate-side connection terminals 20 are also formed on the lower surface L2 of the cover plate 6 in the vicinity of the additional slit 10. The vicinity refers to the periphery of a region where the additional slit 10 is formed, and is a position corresponding to the common terminal 18 when the actuator substrate 2 and the cover plate 6 are joined together. The cover plate-side connection terminals 20 are continued to the additional wiring 16.

At the substrate joining step S4, the ejection grooves 3 of the actuator substrate 2 and the slits 9 of the cover plate 6 are brought into communication with each other, and the actuator-side connection terminals 19 and the cover plate-side connection terminals 20 are brought into contact with each other and are electrically connected. Accordingly, the conductive films 11 formed on the plurality of the ejection grooves 3 (the common drive electrodes 12) and the conductive films 11 formed on the inner side surfaces of the slits 9 and the inner surface of the recessed portion 7 (the common wiring 15) are electrically connected.

Also at the substrate joining step S4, the additional slit 10 and the wiring groove 5 are brought into communication with each other, and common terminal 18 and the cover plate-side connection terminals 20 are brought into contact with each other and are electrically connected. Accordingly, the conductive films 11 formed on the plurality of the ejection grooves 3 (the common drive electrodes 12) are electrically connected to the common terminal 18 via the actuator-side connection terminals 19, the cover plate-side connection terminals 20, the common wiring 15, the additional wiring 16, and the cover plate-side connection terminals 20.

Third Embodiment

Figure 5:
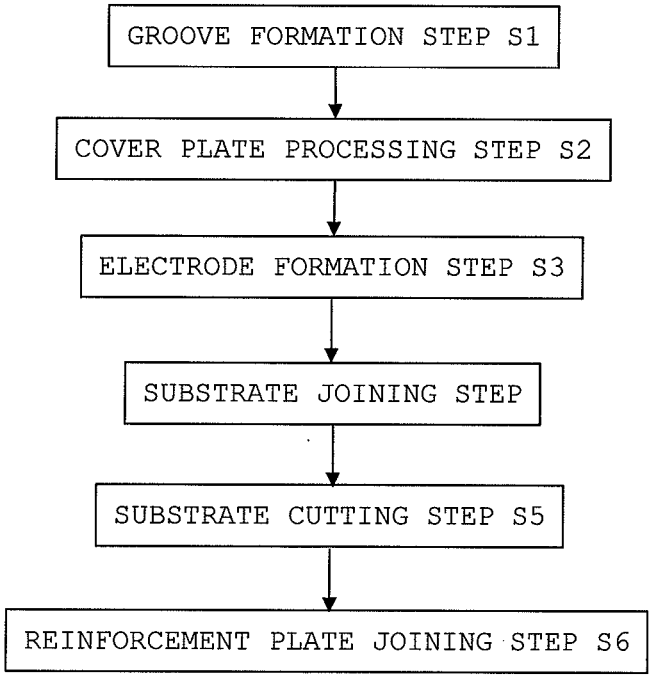
FIG. 5 is a process chart describing a manufacturing method of the liquid jet head according to a third embodiment of the present invention.

FIG. 5 is a process chart describing a manufacturing method of the liquid jet head 1 according to a third embodiment of the present invention. FIGS. 6A to 9 are explanatory diagrams of the manufacturing method of the liquid jet head 1 according to the third embodiment of the present invention. The same components or the components having the same functions are given the same reference signs.

As illustrated in FIG. 5, the manufacturing method of the liquid jet head 1 of the present invention includes a groove formation step S1 of forming the ejection grooves 3 and the non-ejection grooves 4 in the actuator substrate 2, a cover plate processing step S2 of forming the recessed portion 7 and the slits 9 in the cover plate 6, an electrode formation step S3 of forming the conductive films 11, a substrate joining step S4 of joining the cover plate 6 and the actuator substrate 2, a substrate cutting step S5 of cutting the lower surface L1 of the actuator substrate 2 opposite to the upper surface U1, and a reinforcing plate joining step S6 of joining a reinforcing plate 21 to the lower surface L1 of the actuator substrate 2. Therefore, the substrate cutting step S5 and the reinforcing plate joining step S6 are added to the manufacturing method of the second embodiment. As in the second embodiment, the conductive films 11 formed on the plurality of the ejection grooves 3 are electrically connected to the conductive films 11 formed on the inner side surfaces of the slits 9 and the inner surface of the recessed portion 7 via the actuator-side connection terminals 19 and the cover plate-side connection terminals 20. Further, the substrate cutting step S5 is introduced such that the electrode formation step S3 is performed in the state in which the ejection grooves 3 and the non-ejection grooves 4 are opened in the lower surface L1 of the actuator substrate 2. This facilitates the formation of the conductive films 11 on the both side surfaces of the ejection grooves 3 and the non-ejection grooves 4. Specific explanation will be given below.

Figure 6A:
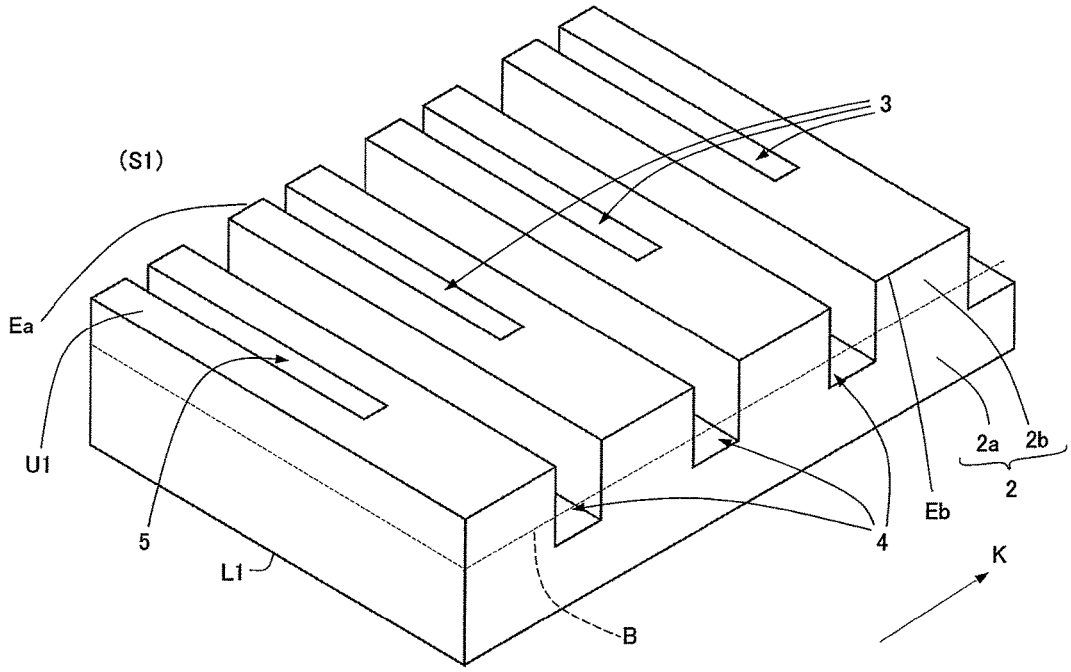
FIG. 6A is an explanatory diagram of the manufacturing method of the liquid jet head according to the third embodiment of the present invention.

As illustrated in FIG. 6A, at the groove formation step S1, the ejection grooves 3 and the non-ejection grooves 4 are alternately formed in the upper surface U1 of the actuator substrate 2 in the reference direction K. The actuator substrate 2 is made of a piezoelectric material such as a PZT ceramic and is a chevron substrate in which the directions of polarization are vertically different. Specifically, the actuator substrate 2 is a laminated substrate in which a piezoelectric substrate 2*a* polarized in the normal direction of the substrate surface and a piezoelectric substrate 2*b* polarized in the direction opposite to the piezoelectric substrate 2*a* are laminated. The ejection grooves 3 and the non-ejection grooves 4 can be formed by cutting the actuator substrate 2 with a dicing blade in which abrasive grain for grinding is embedded in the outer periphery of a disc-shaped blade (also called diamond blade). The ejection grooves 3 are formed by cutting from the one end portion Ea to a position immediately before the other end portion Eb of the upper surface U1. The non-ejection grooves 4 are formed at the same depth by cutting from the one end portion Ea to the other end portion Eb of the upper surface U1. The cutting is performed with a groove length of 20 to 200 μm, a final groove depth of 150 to 700 μm, and the boundary B between the piezoelectric substrate 2*a* and the piezoelectric substrate 2*b* of approximately ½ the final groove depth.

At the groove formation step S1, the wiring groove 5 is formed in the upper surface U1 of the actuator substrate 2 on the one end portion Ea side in the vicinity of the end portion in the reference direction K and in parallel to the non-ejection grooves 4. The wiring groove 5 is made shallower than the non-ejection grooves 4. The wiring groove 5 may be extended to the other end portion Eb of the actuator substrate 2. After the formation of the ejection grooves 3 and the non-ejection grooves 4, the piezoelectric substrate 2*b* is left under the ejection grooves 3 and the non-ejection grooves 4 to ensure the strength of the actuator substrate 2.

Figure 6B:
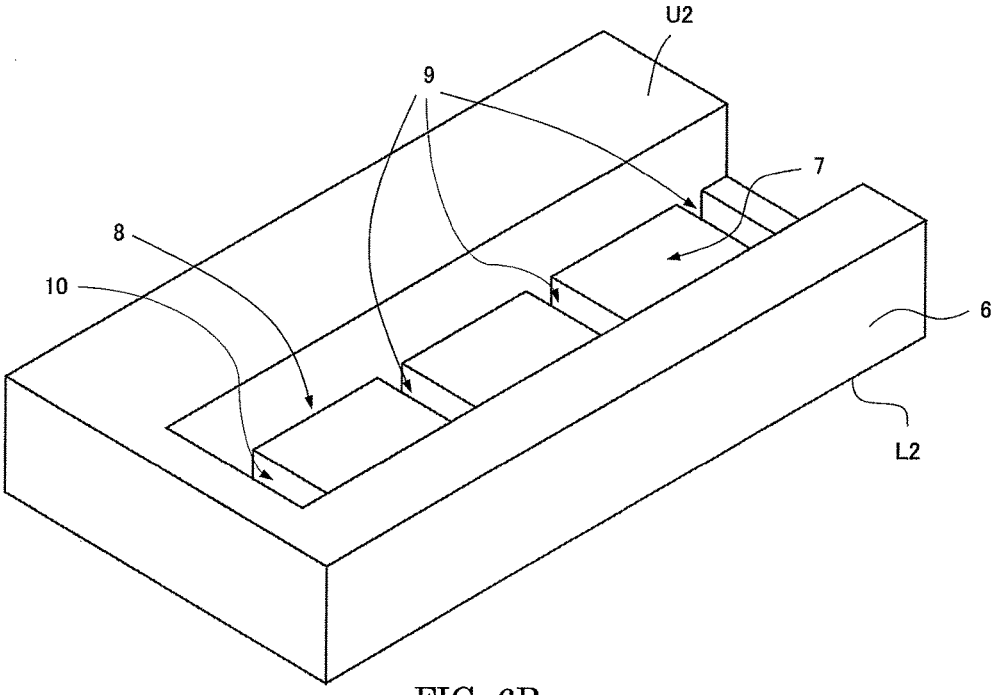
FIG. 6B is an explanatory diagram of the manufacturing method of the liquid jet head according to the third embodiment of the present invention.

As illustrated in FIG. 6B, at the cover plate processing step S2, the recessed portion 7 and the slits 9 penetrating from the bottom surface of the recessed portion 7 to the lower surface L2 opposite to the upper surface U2 are formed in the upper surface U2 of the cover plate 6. The cover plate 6 can be made of a PZT ceramic material, another ceramic material, an insulating material, a glass material, or a plastic material having a linear expansion coefficient of the same degree as that of the actuator substrate 2. The recessed portion 7 and the slits 9 can be formed by sandblasting, etching, or the like.

The cover plate processing step S2 includes forming the additional recessed portion 8 communicating with the recessed portion 7 in the upper surface U2 of the cover plate 6 and forming the additional slit 10 penetrating from the bottom surface of the additional recessed portion 8 to the lower surface L2 opposite to the upper surface U2.

Figure 8A:
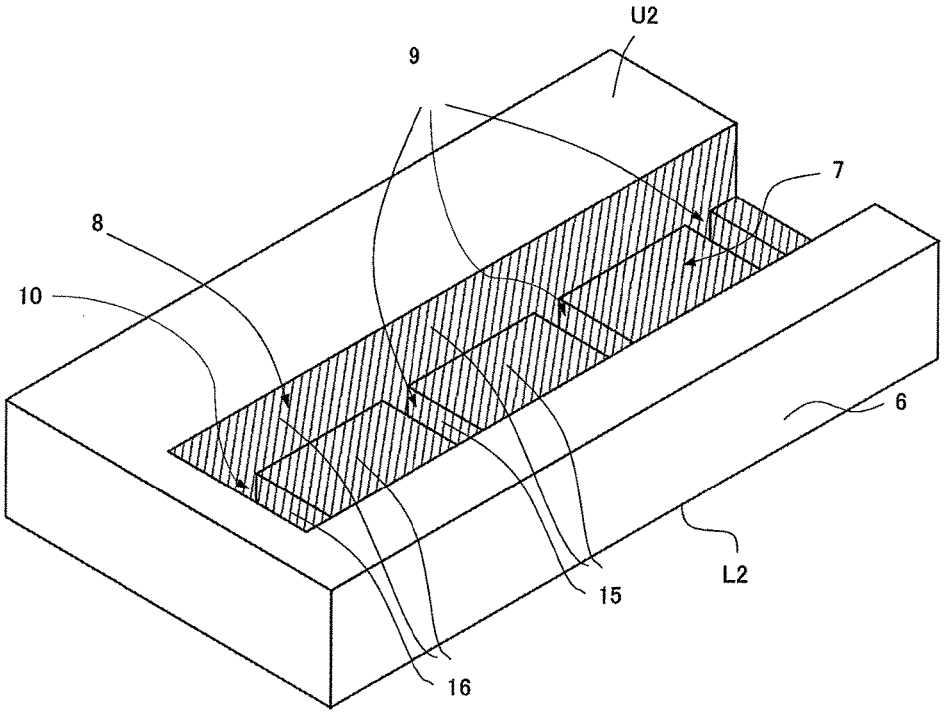
FIG. 8A is an explanatory diagram of the manufacturing method of the liquid jet head according to the third embodiment of the present invention.
Figure 8B:
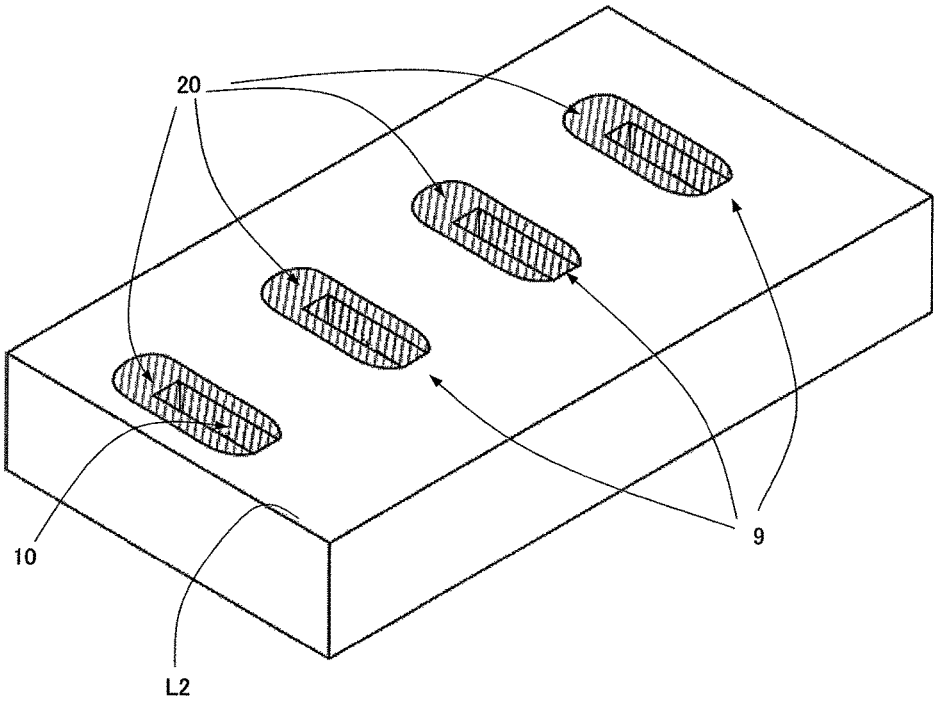
FIG. 8B is an explanatory diagram of the manufacturing method of the liquid jet head according to the third embodiment of the present invention.

Next, as illustrated in FIGS. 7, 8A, and 8B, at the electrode formation step S3, the conductive films 11 are formed on the both side surfaces of the ejection grooves 3, the portions where the common terminal 18 and the actuator-side connection terminals 19 are to be formed, the both side surfaces of the non-ejection grooves 4, the inner surface (side surfaces and bottom surface) of the wiring groove 5, the inner side surfaces of the slits 9, the portions where the cover plate-side connection terminals 20 are to be formed, the inner surface of the recessed portion 7, the inner surface of the additional recessed portion 8, the inner side surfaces of the additional slit 10, and the upper surface U1 of the actuator substrate 2 in the vicinity of the other end portion Eb.

Specifically, first, a catalyst is selectively adsorbed onto the outer surfaces of the cover plate 6 and the actuator substrate 2. Next, a metallic film is deposited by electroless plating method in the regions onto which the catalyst is adsorbed to selectively form the conductive films 11. Alternatively, nickel, gold, copper, silver, or any other metal or alloy may be deposited by electroless plating method.

As a result, the common drive electrodes 12 (see FIG. 1) are formed on the both side surfaces of the ejection grooves 3, the common wiring 15 is formed on the inner side surfaces of the slits 9 and the inner surface of the recessed portion 7, the additional wiring 16 is formed on the inner side surfaces of the additional slit 10 and the inner surface of the additional recessed portion 8, the wiring electrode 14 are formed on the inner surface of the wiring groove 5, the cover plate-side connection terminals 20 are formed on the lower surface L2 of the cover plate 6, and the common terminal 18 and the actuator-side connection terminals 19 are formed on the upper surface U1 of the actuator substrate 2 in the vicinity of the other end portion Eb in the end regions in the reference direction K. These electrodes and terminals are electrically connected in sequence to the common drive electrodes 12, the actuator-side connection terminals 19, the cover plate-side connection terminals 20, the common wiring 15, the additional wiring 16, the cover plate-side connection terminals 20, and the common terminal 18.

Further, the individual drive electrodes 13 are formed on the both sides of the non-ejection grooves 4, and the individual terminals 17 are formed on the upper surface U1 of the actuator substrate 2 in the vicinity of the other end portion Eb on the side closer the end portion Eb than the ejection grooves 3. The individual drive electrodes 13 formed on the both sides of the non-ejection grooves 4 are electrically separated from each other. The two individual drive electrodes 13 formed, on the side of the ejection groove 3, on the surfaces of the two non-ejection grooves 4 sandwiching the ejection groove 3 therebetween are electrically connected to the individual terminals 17. The individual terminals 17 are electrically separated from the actuator-side connection terminals 19, and are arranged closer to the end portion Eb side than the actuator-side connection terminals 19.

As described above, the individual drive electrodes 13 opposed to each other in the single non-ejection groove 4 need to be electrically separated from each other. To implement this configuration, the cover plate 6 is made of, for example, a glass material and, at the cover plate processing step S2, the lower surface L2 of the cover plate 6 is mirror-finished. Accordingly, the conductive film 11 is not deposited on the lower surface L2 even when the lower surface L2 is immersed in the electroless plating solution. As a result, the conductive film 11 is not formed on the upper surfaces of the non-ejection grooves 4 (the lower surface L2 of the cover plate 6) so that the opposed individual drive electrodes 13 in the single non-ejection groove 4 can be electrically separated from each other.

Alternatively, at the electrode formation step S3, masks such as dry films may be stuck to the actuator substrate 2 and the cover plate 6 before electroless plating to prevent the deposition of the conductive films 11. In this case, there is no need to subject the lower surface L1 of the actuator substrate 2 and the upper surface U2 of the cover plate 6 to mirror finishing. Still alternatively, at the electrode formation step S3, after electroless plating of the cover plate 6 and the actuator substrate 2, the upper surface U2 of the cover plate 6 or the lower surface L1 of the actuator substrate 2 may be ground to remove the deposited conductive films 11.

Next, although not illustrated, at the substrate joining step S4, the lower surface L2 of the cover plate 6 is joined via an adhesive to the upper surface U1 of the actuator substrate 2 to communicate the slits 9 with the ejection grooves 3. At the same time, the additional slit 10 and the wiring groove 5 are communicated with each other, and the actuator-side connection terminals 19 and the cover plate-side connection terminals 20 are connected together. Accordingly, the conductive films 11 (the common drive electrodes 12) formed on the plurality of the ejection grooves 3 and the conductive films 11 (the common wiring 15) formed on the inner side surfaces of the slits 9 and the inner surface of the recessed portion 7 are electrically connected together. At the substrate joining step S4, the cover plate 6 is joined to the actuator substrate 2 in such a manner that the upper surface U1 of the actuator substrate 2 in the vicinity of the other end portion Eb and the non-ejection grooves 4 in the vicinity of the other end portion Eb are exposed to the outside.

Next, although not illustrated, at the substrate cutting step S5, the lower surface L1 of the actuator substrate 2 is cut to open the ejection grooves 3 and the non-ejection grooves 4 in the lower surface L1. Note that the side walls of the ejection grooves 3 and the non-ejection grooves 4 are not disassembled even when the bottom portions are opened because the upper portions are fixed by the cover plate 6. The lower surface L1 is cut such that the boundary B between the piezoelectric substrate 2*a* and the piezoelectric substrate 2*b* are positioned at approximately ½ the depth of the grooves.

Figure 9:
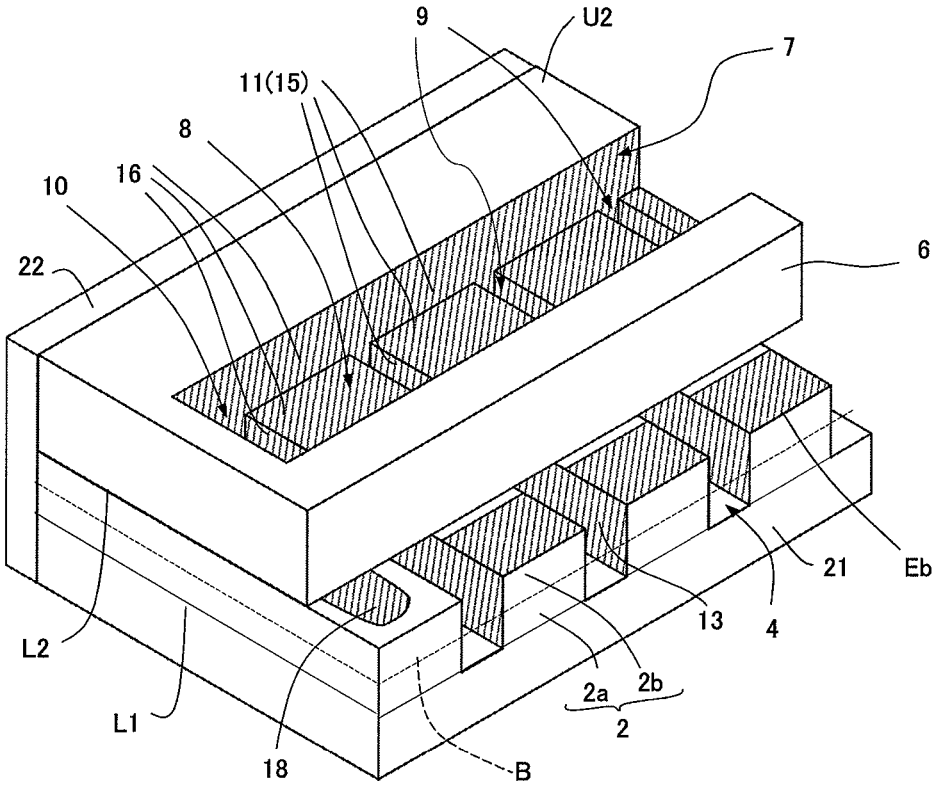
FIG. 9 is an explanatory diagram of the manufacturing method of the liquid jet head according to the third embodiment of the present invention.

Next, as illustrated in FIG. 9, at the reinforcing plate joining step S6, the reinforcing plate 21 is joined via an adhesive to the lower surface L1 of the actuator substrate 2. The reinforcing plate 21 can be made of a PZT ceramic material same as that for the actuator substrate 2, a glass material, any other insulating material, a plastic material, or the like. Next, the nozzle plate 22 is adhered to the one end surface of the actuator substrate 2, the reinforcing plate 21, and the cover plate 6 that are flush with one another so as to communicate the nozzles 23 formed in the nozzle plate 22 with the ejection grooves 3. In addition, the wiring groove 5 or the additional slit 10 is closed by charging an adhesive or the like so as to prevent the liquid flowing into the recessed portion 7 from leaking to the outside.

The liquid jet head 1 manufactured in this manner electrically connects the common drive electrodes 12 (see FIG. 1), the actuator-side connection terminals 19, the cover plate-side connection terminals 20, the common wiring 15, the additional wiring 16, the wiring electrode 14, and the common terminal 18, and electrically connects the individual drive electrodes 13 and the individual terminals 17. Further, the individual terminals 17 can be electrically separated from each other, and the individual terminals 17 and the common terminal 18 can be electrically separated from each other.

In the embodiment, the common drive electrodes 12 formed in the plurality of the ejection grooves 3 are electrically connected to the common terminal 18 via the common wiring 15, the additional wiring 16, and the wiring electrode 14. Alternatively, the common terminal 18 may be installed on the upper surface U2 of the cover plate 6. In this case, the wiring groove 5 is not formed at the groove formation step S1 and the additional recessed portion 8 and the additional slit 10 are not formed at the cover plate processing step S2, and alternatively a rough-surfaced region is formed on the upper surface U2 of the cover plate 6 in such a manner as to continue from the opening end of the recessed portion 7. A palladium catalyst may be adsorbed to the rough-surfaced region to form the common terminal 18 of nickel film and gold film or the like by electroless plating method.

In the embodiment, the liquid jet head 1 is an edge-chute type. Alternatively, the side-chute type liquid jet head 1 may be formed. Specifically, at the groove formation step S1, the ejection grooves 3 are formed on the upper surface U1 of the actuator substrate 2 from a position immediately before the one end portion Ea to a position immediately before the other end portion Eb. At the cover plate processing step S2, a recessed portion and slits communicating with the one end side of the ejection grooves 3 are formed, and other recessed portion and slits communicating with the other end side of the ejection grooves 3 are formed. Then, instead of the reinforcing plate 21, the nozzle plate 22 is adhered to the lower surface L1 of the actuator substrate 2 to communicate the nozzles 23 in the nozzle plate 22 with the ejection grooves 3.

In addition, light-pervious substrates made of a glass material or the like can be used for the cover plate 6 and the reinforcing plate 21. By using the light-pervious cover plate 6, for example, when the conductive films 11 (the individual drive electrodes 13) on the both side surfaces of the non-ejection grooves 4 are short-circuited or the like at the electrode formation step S3, the short-circuited part is irradiated with laser light through the cover plate 6 or the reinforcing plate 21 to scatter the conductive material in the short-circuited part and recover from the short-circuit.

In addition, in the embodiment, the reinforcing plate joining step S6 is performed after the electrode formation step S3. Alternatively, the reinforcing plate joining step S6 may be performed before the electrode formation step S3. That is, after the reinforcing plate 21 is joined to the joined actuator substrate 2 and cover plate 6, the electrode formation step S3 may be carried out to form the conductive films 11. In this case, as described above, the opposed individual drive electrodes 13 in the single non-ejection groove 4 need to be electrically separated from each other. To implement this configuration, the reinforcing plate 21 is made of a glass material, for example, and the surface of the reinforcing plate 21 is not roughened but mirror-finished. Accordingly, no conductive film is formed on the surface of the reinforcing plate 21 by electroless plating method and thus no conductive film is formed on the bottom surface of the non-ejection groove 4. This allows the opposed individual drive electrodes 13 in the single non-ejection groove 4 to be electrically separated from each other.

Fourth Embodiment

Figure 10:
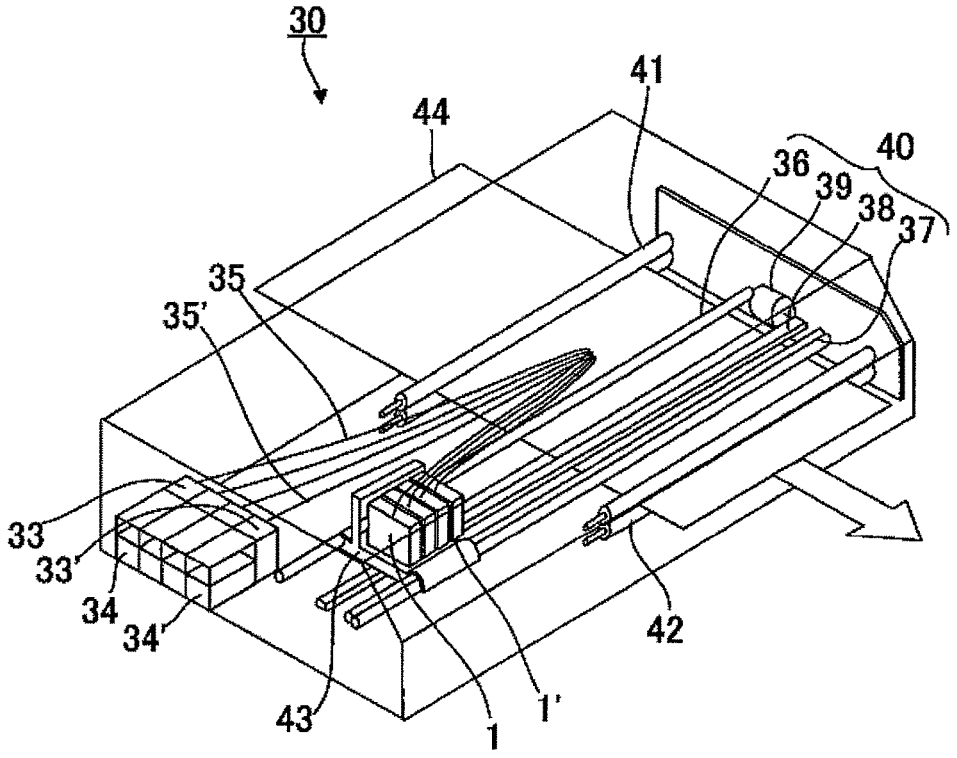
FIG. 10 is a schematic perspective view of a liquid jet apparatus according to a fourth embodiment of the present invention.
Figure 11:
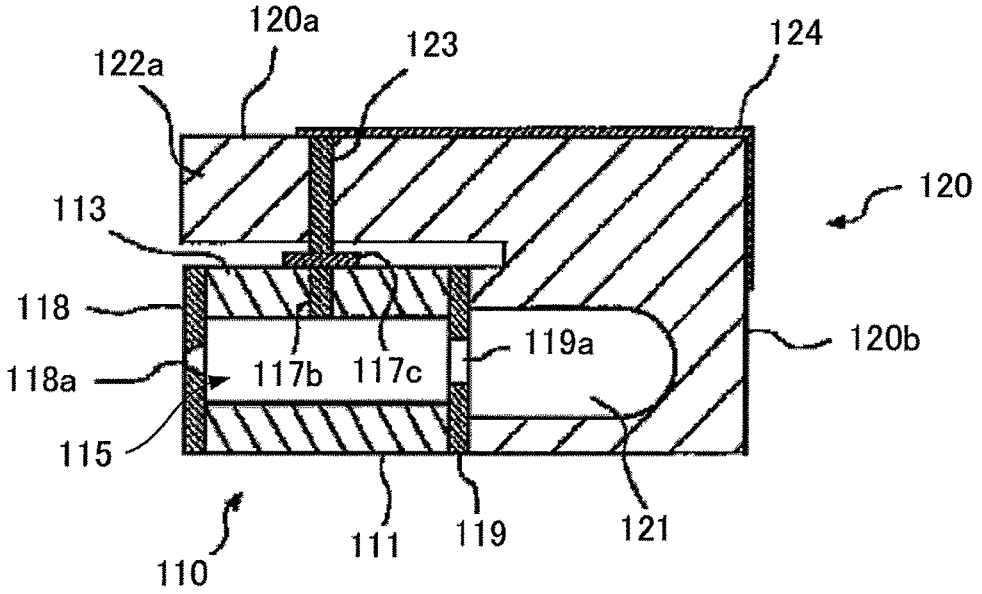
FIG. 11 is a schematic cross-sectional view of a conventional publicly-known liquid jet head.

FIG. 10 is a schematic perspective view of a liquid jet apparatus 30 according to a fourth embodiment of the present invention. The liquid jet apparatus 30 includes a movement mechanism 40 that reciprocates liquid jet heads 1 and 1', flow path portions 35 and 35' that supply liquids to the liquid jet heads 1 and 1' and discharge the liquids from the liquid jet heads 1 and 1', liquid pumps 33 and 33' that communicate with the flow path portions 35 and 35', and liquid tanks 34 and 34'. As the liquid pumps 33 and 33', either or both of supply pumps supplying liquids to the flow path portions 35 and 35' and discharge pumps discharging the liquids can be installed to circulate the liquids. In addition, a pressure sensor or a flow rate sensor not illustrated can be installed to control the flow rate of the liquids. The liquid jet heads 1 and 1' can be the liquid jet heads 1 of the first embodiment or the liquid jet heads 1 manufactured by the manufacturing method of the second or third embodiment.

The liquid jet apparatus 30 includes a pair of conveyance means 41 and 42 that conveys a recording medium 44 such as paper in a main scanning direction, the liquid jet heads 1 and 1' that jet liquids to the recording medium 44, a carriage unit 43 on which the liquid jet heads 1 and 1' are placed, the liquid pumps 33 and 33' that supply the liquids reserved in the liquid tanks 34 and 34' under pressure to the flow path portions 35 and 35', and the movement mechanism 40 that performs scanning with the liquid jet heads 1 and 1' in a sub scanning direction orthogonal to the main scanning direction. A control unit not illustrated controls and drives the liquid jet heads 1 and 1', the movement mechanism 40, the conveyance means 41 and 42.

The pair of conveyance means 41 and 42 extends in the sub scanning direction and includes grid rollers and pinch rollers that rotate with the roller surfaces in contact with each other. The grid rollers and the pinch rollers are axially moved by a motor not illustrated to convey the recording medium 44 sandwiched between the rollers in the main scanning direction. The movement mechanism 40 includes a pair of guide rails 36 and 37 extending in the sub scanning direction, a carriage unit 43 that is capable of sliding along the pair of guide rails 36 and 37, an endless belt 38 that is coupled to the carriage unit 43 to move the carriage unit 43 in the sub scanning direction, and a motor 39 that causes the endless belt 38 to circulate via a pulley not illustrated.

The carriage unit 43 has a plurality of the liquid jet heads 1 and 1' placed thereon and jets liquid droplets of four colors, for example, yellow, magenta, cyan, and black. The liquid tanks 34 and 34' reserve the liquids of the corresponding colors and supply the same to the liquid jet heads 1 and 1' via the liquid pumps 33 and 33' and the flow path portions 35 and 35'. The liquid jet heads 1 and 1' jet the liquid droplets of the respective colors according to the drive signal. It is possible to record an arbitrary pattern on the recording medium 44 by controlling the timing for jetting the liquids form the liquid jet heads 1 and 1', the rotation of the motor 39 driving the carriage unit 43, and the conveyance speed of the recording medium 44.

In the liquid jet apparatus 30 of the embodiment, the movement mechanism 40 moves the carriage unit 43 and the recording medium 44 to make a recording. Alternatively, the liquid jet apparatus may be configured such that the carriage unit is fixed and the movement mechanism moves the recording medium two-dimensionally to make a recording. That is, the movement mechanism allows the liquid jet head and the recording medium to move relatively.

What is claimed is:

1. A liquid jet head comprising:

an actuator substrate in which ejection grooves and non-ejection grooves are arranged alternately in a reference direction; and a cover plate that is joined to the actuator substrate and includes a recessed portion in an upper surface and slits penetrating from a bottom surface of the recessed portion to a lower surface of the cover plate and communicating with the ejection grooves, wherein common drive electrodes are formed on side surfaces of the ejection grooves, actuator-side connection terminals continued to the common drive electrodes are formed on an upper surface of the actuator substrate in the vicinity of longitudinal end portions of the ejection grooves, and individual drive electrodes are formed on side surfaces of the non-ejection grooves, and common wiring is formed on inner side surfaces of the slits and an inner surface of the recessed portion, cover plate-side connection terminals continued to the common wiring are formed on a lower surface of the cover plate at positions corresponding to the actuator-side connection terminals, and the common drive electrodes formed in a plurality of the ejection grooves are electrically connected together via the actuator-side connection terminals, the cover plate-side connection terminals, and the common wiring.

2. The liquid jet head according to claim 1, wherein the non-ejection grooves are formed from one end portion to the other end portion of the actuator substrate, the ejection grooves are formed from the one end portion to a position immediately before the other end portion of the actuator substrate, the cover plate is joined to the upper surface of the actuator substrate such that the slits and the ejection grooves communicate with each other, individual terminals are formed on the upper surface of the actuator substrate in the vicinity of the other end portion, and the individual terminals electrically connect two of the individual drive electrodes formed in adjacent two of the non-ejection grooves sandwiching the ejection groove therebetween.

3. The liquid jet head according to claim 2, wherein the actuator substrate includes a wiring groove formed in the vicinity of the end portion in the reference direction, a wiring electrode formed on the inner surface of the wiring groove, and a common terminal formed on an upper surface where the wiring groove is opened, the cover plate includes an additional recessed portion that communicates with the recessed portion, an additional slit that penetrates from a bottom surface of the additional recessed portion to a lower surface the cover plate, additional wiring that is formed on an inner surface of the additional recessed portion and inner side surfaces of the additional slit, and cover plate-side connection terminals that are continued to the additional wiring and formed on the lower surface of the cover plate at positions corresponding to the common terminal, and the common terminal is electrically connected to the common wiring via the cover plate-side connection terminals, the wiring electrode, and the additional wiring.

4. The liquid jet head according to claim 3, wherein the actuator substrate includes individual terminals electrically connected to the individual drive electrodes, the common terminal is electrically connected to the common wiring and is formed on the upper surface of the actuator substrate at the end portion side in the reference direction, and the individual terminals are formed on the upper surface of the actuator substrate more inside than the common terminal in the reference direction.

5. The liquid jet head according to claim 1, wherein the actuator substrate includes a wiring groove formed in the vicinity of the end portion in the reference direction, a wiring electrode formed on the inner surface of the wiring groove, and a common terminal formed on an upper surface where the wiring groove is opened, the cover plate includes an additional recessed portion that communicates with the recessed portion, an additional slit that penetrates from a bottom surface of the additional recessed portion to a lower surface the cover plate, additional wiring that is formed on an inner surface of the additional recessed portion and inner side surfaces of the additional slit, and cover plate-side connection terminals that are continued to the additional wiring and formed on the lower surface of the cover plate at positions corresponding to the common terminal, and the common terminal is electrically connected to the common wiring via the cover plate-side connection terminals, the wiring electrode, and the additional wiring.

6. The liquid jet head according to claim 5, wherein the actuator substrate includes individual terminals electrically connected to the individual drive electrodes, the common terminal is electrically connected to the common wiring and is formed on the upper surface of the actuator substrate at the end portion side in the reference direction, and the individual terminals are formed on the upper surface of the actuator substrate more inside than the common terminal in the reference direction.

7. A liquid jet apparatus comprising:

the liquid jet head according to claim 1;

a movement mechanism configured to move relatively the liquid jet head and a recording medium;

a liquid supply tube configured to supply a liquid to the liquid jet head; and a liquid tank configured to supply the liquid to the liquid supply tube.

* * * * *